US011382475B2

(12) United States Patent
Pougher et al.

(10) Patent No.: US 11,382,475 B2
(45) Date of Patent: Jul. 12, 2022

(54) SURFACE CLEANING APPARATUS

(71) Applicant: TTI (MACAO COMMERCIAL OFFSHORE) LIMITED, Macau (CN)

(72) Inventors: Simon Pougher, Birmingham West Midlands (GB); Darren Holmes, Birmingham West Midlands (GB); Richard Waters, Birmingham West Midlands (GB); Anna Jaanus, Birmingham West Midlands (GB); Jose Casella, Birmingham West Midlands (GB)

( * ) Notice: Subject to any disclaimer, the term of this patent is extended or adjusted under 35 U.S.C. 154(b) by 67 days.

(21) Appl. No.: 16/624,652

(22) PCT Filed: Jun. 19, 2017

(86) PCT No.: PCT/GB2017/051786

§ 371 (c)(1),
(2) Date: Dec. 19, 2019

(87) PCT Pub. No.: WO2018/234722

PCT Pub. Date: Dec. 27, 2018

(65) Prior Publication Data

US 2020/0129028 A1 Apr. 30, 2020

(51) Int. Cl.
*A47L 9/28* (2006.01)
*A47L 5/24* (2006.01)
(Continued)

(52) U.S. Cl.
CPC ..... *A47L 9/2884* (2013.01); *A47L 5/24* (2013.01); *A47L 9/1608* (2013.01); *A47L 9/322* (2013.01)

(58) Field of Classification Search
CPC ..... A47L 9/16; A47L 9/1608; A47L 9/1616; A47L 9/1625; A47L 9/1633;
(Continued)

(56) References Cited

U.S. PATENT DOCUMENTS 6,326,776 B1 12/2001 Small
6,380,713 B2 4/2002 Namura
(Continued)

FOREIGN PATENT DOCUMENTS

CH 707432 A2 7/2014
CN 101940452 A 1/2011
(Continued)

OTHER PUBLICATIONS

JP-2016137095-A translation Espacenet (Year: 2021).*
(Continued)

*Primary Examiner* — Joseph J Hail
*Assistant Examiner* — Timothy Brady
(74) *Attorney, Agent, or Firm* — Michael Best & Friedrich LLP

(57) ABSTRACT

A surface cleaning apparatus including: a housing supporting: a suction source including a motor with an axle having an axis (A) which rotates a fan; a dirt collection chamber having an elongate axis (B); and a battery for providing power to operate the suction source, wherein the battery has an elongate axis (C); wherein the axis (A) of the motor axle and the elongate axis (B) of the dirt collection chamber extend transversely with respect to the elongate axis (C) of the battery.

20 Claims, 10 Drawing Sheets

(51) Int. Cl.
*A47L 9/16* (2006.01)
*A47L 9/32* (2006.01)

(58) Field of Classification Search
CPC ..... A47L 9/1641; A47L 9/165; A47L 9/1658; A47L 9/1666; A47L 9/1675; A47L 9/1683; A47L 9/1691; A47L 9/10; A47L 9/102; A47L 9/104; A47L 9/106; A47L 9/22; A47L 9/24; A47L 9/242; A47L 9/244; A47L 9/00; A47L 9/2884; A47L 9/322; A47L 9/32; A47L 9/325; A47L 5/06; A47L 5/22; A47L 5/24; A47L 5/26; A47L 5/28; A47L 5/30; A47L 5/362; A47L 5/32; A47L 5/34; A47L 11/00; A47L 11/04; A47L 11/40; A47L 13/00; B65D 51/248; B65D 55/026; B65D 55/02; B65D 2203/12
USPC .... 15/327.7, 328, 353, 300.1, 344, 347–352
See application file for complete search history.

(56) References Cited

U.S. PATENT DOCUMENTS 6,629,767 B2 10/2003 Osiecki et al.
6,646,414 B2 11/2003 Small
6,777,910 B2 8/2004 Small
6,779,227 B2 8/2004 Lee
D516,502 S 3/2006 Small
7,370,387 B2 5/2008 Walker et al.
7,470,485 B2 12/2008 Kang et al.
7,614,469 B2 11/2009 Kumar et al.
7,648,383 B2 1/2010 Matthias et al.
7,698,779 B2 4/2010 Schliemann et al.
7,781,091 B2 8/2010 Matsuoka et al.
7,837,434 B2 11/2010 Rabis et al.
7,879,482 B2 2/2011 Matthias
8,028,373 B2 10/2011 Rowntree
RE42,873 E 11/2011 Walker et al.
8,114,536 B2 2/2012 Kang et al.
8,114,537 B2 2/2012 Kang et al.
RE43,804 E 11/2012 Walker et al.
8,484,799 B2 7/2013 Conrad
8,528,160 B2 9/2013 Conrad
8,549,703 B2 10/2013 Smith
8,578,555 B2 11/2013 Conrad
8,590,103 B2 11/2013 Wolfe, Jr.
8,595,895 B2 12/2013 Smith
8,632,899 B2 1/2014 Ro
8,646,149 B2 2/2014 Conrad
8,657,904 B2 2/2014 Smith
8,671,508 B2 3/2014 Nagasaka et al.
8,691,420 B2 4/2014 Yoo
8,691,428 B2 4/2014 Lee
8,739,357 B2 6/2014 Conrad
8,763,202 B2 7/2014 Conrad
8,769,767 B2 7/2014 Conrad
8,795,873 B2 8/2014 Ahn
8,813,305 B2 8/2014 Conrad
8,813,306 B2 8/2014 Conrad
8,869,345 B2 10/2014 Conrad
8,879,225 B2 11/2014 Liebhard et al.
8,918,952 B2 12/2014 Rowntree
8,973,212 B2 3/2015 Conrad
8,973,214 B2 3/2015 Conrad
8,978,198 B2 3/2015 Conrad
8,979,960 B2 3/2015 Smith
9,101,252 B2 8/2015 Conrad
9,159,965 B2 10/2015 Lee
9,159,982 B2 10/2015 Wood et al.
9,243,854 B2 1/2016 Gong et al.
9,257,690 B2 2/2016 Zhang et al.
9,265,395 B2 2/2016 Conrad
9,331,316 B2 5/2016 Bae
9,478,362 B2 10/2016 Ninomiya et al.
9,508,966 B2 11/2016 Gunna et al.
9,553,289 B2 1/2017 Lee et al.
9,653,748 B2 5/2017 Kruger et al.
9,755,198 B2 9/2017 Blumka et al.
9,861,241 B2 1/2018 Rowntree
2004/0201365 A1 10/2004 Small
2005/0155176 A1 7/2005 Chen
2005/0155177 A1* 7/2005 Baer ..... A47L 5/365 15/353
2005/0210624 A1 9/2005 Lammers et al.
2006/0288516 A1 12/2006 Sawalski
2008/0104793 A1 5/2008 Kang et al.
2011/0293971 A1 12/2011 Ho et al.
2012/0073848 A1 3/2012 Shumizu et al.
2012/0156537 A1 6/2012 Meintschel et al.
2012/0301762 A1 11/2012 Welker et al.
2012/0308864 A1 12/2012 Meintschel et al.
2013/0091658 A1* 4/2013 Smith ..... A47L 9/009 15/347
2013/0091810 A1 4/2013 Smith
2013/0091815 A1* 4/2013 Smith ..... A47L 9/106 55/346
2013/0180684 A1 7/2013 Gong et al.
2014/0220388 A1 8/2014 Lee
2014/0220412 A1 8/2014 Lee et al.
2014/0220418 A1 8/2014 Hsiao
2014/0242449 A1 8/2014 Lee et al.
2015/0064541 A1 3/2015 Noh et al.
2015/0072178 A1 3/2015 Gu
2015/0079451 A1 3/2015 Jeong et al.
2015/0118530 A1 4/2015 Lee
2015/0125728 A1 5/2015 Yi et al.
2015/0155606 A1* 6/2015 Stickney ..... H01M 50/213 429/90
2015/0289733 A1 10/2015 Rowntree
2015/0289736 A1 10/2015 Rowntree
2016/0028054 A1 1/2016 Moon
2016/0113455 A1* 4/2016 Horvath ..... A47L 5/24 15/344
2016/0128527 A1* 5/2016 Grey ..... A47L 5/24 15/344
2016/0133889 A1 5/2016 Tseng et al.
2016/0174786 A1 6/2016 Conrad
2016/0226038 A1 8/2016 Kim et al.
2016/0270613 A1 9/2016 Demirtas et al.
2016/0285143 A1 9/2016 Rief et al.
2017/0015397 A1 1/2017 Mitchell et al.
2017/0035261 A1* 2/2017 Lauer ..... A47L 7/0019
2017/0077469 A1 3/2017 Gunna et al.
2017/0196428 A1* 7/2017 Brown ..... H02J 7/0013
2017/0209010 A1* 7/2017 Peters ..... A47L 5/24
2017/0258282 A1* 9/2017 Shinagawa ..... A47L 9/12
2017/0290481 A1* 10/2017 Conrad ..... A47L 5/24
2017/0332860 A1* 11/2017 Nam ..... A47L 9/22
2019/0183308 A1* 6/2019 Hwang ..... G05F 1/00
2019/0208974 A1* 7/2019 Oka ..... A47L 9/246
2020/0037834 A1* 2/2020 Li ..... A47L 9/322

FOREIGN PATENT DOCUMENTS

CN 202699031 U 1/2013
CN 202699032 U 1/2013
CN 103784081 A 5/2014
CN 104201304 A 12/2014
CN 105231960 A 1/2016
CN 205144449 U 4/2016
CN 205251428 U 5/2016
CN 105919515 * 9/2016
CN 105935275 * 9/2016
CN 106384799 A 2/2017
CN 206179956 U 5/2017
CN 206225435 U 6/2017
DE 20202690 U1 6/2002
DE 202004002431 U1 4/2004
DE 202010014511 U1 12/2010
DE 102010060374 A1 8/2011
DE 102014220844 A1 4/2016
EP 0898921 A1 3/1999

(56) References Cited

FOREIGN PATENT DOCUMENTS

| | | | | |
|---|---|---|---|---|
| EP | 2333874 | A1 | | 6/2011 |
| EP | 2578124 | A2 | | 4/2013 |
| EP | 2581012 | A1 | | 4/2013 |
| FR | 2961083 | A1 | | 12/2011 |
| GB | 2502976 | A | | 12/2013 |
| GB | 2508035 | A | | 5/2014 |
| GB | 2542387 | A | | 3/2017 |
| JP | 2014-176567 | | * | 3/2013 |
| JP | 2015173673 | A | * | 10/2015 |
| JP | 2016137095 | A | * | 8/2016 |
| WO | 2010013839 | A1 | | 2/2010 |
| WO | 2010134577 | A1 | | 11/2010 |
| WO | 2012130424 | A1 | | 10/2012 |
| WO | 2014141780 | A1 | | 9/2014 |
| WO | 2017052104 | A1 | | 3/2017 |

OTHER PUBLICATIONS

JP-2015173673-A translation Espacenet (Year: 2021).*
JP-2014-176567 translation Espacenet (Year: 2021).*
CN-105935275 translation Espacenet (Year: 2021).*
CN-105919515 translation Espacenet (Year: 2021).*
International Search Report and Written Opinion for Application No. PCT/GB2017/051786 dated Apr. 24, 2018 (12 pages).

* cited by examiner

SURFACE CLEANING APPARATUS

CROSS-REFERENCE TO RELATED APPLICATIONS

The present application is a U.S. National Phase application of PCT/GB2017/051786 filed Jun. 19, 2017, the entire contents of which are herein incorporated by reference.

DESCRIPTION OF INVENTION

This invention relates to a surface cleaning apparatus.

Different kinds of surface cleaning apparatus are known. Upright cleaners are known which have an upright part pivotally connected to a floor head and a user grasps a handle of the upright part to move the floor head back and forth over a floor surface to be cleaned. Cylinder cleaners are known for which the main operative components, i.e. suction source, dirt collection chamber, are supported by a housing having wheels. A rigid elongate member fluidly connects the operative components in the housing to a floor head and the user grasps a handle of the elongate member to move the floor head along the floor surface to be cleaned whilst the housing is moved by pulling the elongate member in the desired direction. Handheld cleaners are known which have a housing containing the operative components of the cleaner and for which the housing can be easily carried by the user during cleaning; such cleaners may or may not include a battery. Stick-vac or pole-vac cleaners are known which are formed by fluidly connecting a housing of a handheld unit to a floor head via a relatively rigid elongate member. For such cleaners, the user can steer the floor head by moving the handheld unit in the desired direction.

Surface cleaning apparatus having a compact configuration and/or ergonomic design are desirable.

According to an aspect of the present invention we provide a surface cleaning apparatus including:

- a housing supporting:
  - a suction source including a motor with an axle having an axis (A) which rotates a fan;
  - a dirt collection chamber having an elongate axis (B); and
  - a battery for providing power to operate the suction source, wherein the battery has an elongate axis (C);
- wherein the axis (A) of the motor axle and the elongate axis (B) of the dirt collection chamber extend transversely with respect to the elongate axis (C) of the battery.

According to a further aspect of the present invention we provide a surface cleaning apparatus including:

- a housing supporting:
  - a suction source including a motor with an axle having an axis (A) which rotates a fan;
  - a dirt collection chamber having an elongate axis (B);
  - a cyclonic separator device having an elongate axis (B') for separating dirt from the airflow through the apparatus; and
  - a battery for providing power to operate the suction source, wherein the battery has an elongate axis (C);
- wherein the axis (A) of the motor axle and the elongate axis (B') of the cyclonic separator device extend transversely with respect to the elongate axis (C) of the battery.

According to a further aspect of the present invention we provide a surface cleaning apparatus including:

- a housing supporting:

- a suction source including a motor with an axle having an axis (A) which rotates a fan;
  - a dirt collection chamber having an elongate axis (B); and
  - a battery for providing power to operate the suction source;
- wherein the battery is positioned underneath the suction source and the dirt collection chamber.

The surface cleaning apparatus may include a cyclonic separating device having an elongate axis for separating dirt from the airflow through the apparatus.

The axis of the axle of the motor and the elongate axis of the dirt collection chamber cyclonic separator device may be substantially parallel or are parallel.

The elongate axis of the battery may be parallel or substantially parallel to an elongate axis of the housing.

The elongate axes of the dirt collection chamber and cyclonic separator device may be parallel with each other, preferably co-axial or substantially co-axial.

The axis of the axle of the motor and the elongate axis of the dirt collection chamber/cyclonic separator device may be spaced apart from the elongate axis of the battery, and optionally or preferably the axis of the axle of the motor is spaced apart from the battery a lesser amount than the elongate axis of the dirt collection chamber/cyclonic separator device.

The dirt collection chamber/cyclonic separator device and suction source may be spaced apart along an elongate axis of the housing.

In normal use, the axis of the axle of the motor may be offset from the elongate axis of the dirt collection chamber/cyclonic separator device.

The axis of the axle of the motor may lie in a first plane and the elongate axis of the dirt collection chamber/cyclonic separator device may lie in a second plane parallel to the first plane, wherein, in normal use, the second plane is below the first plane.

In normal use, the elongate axis of the dirt collection chamber and/or cyclonic separator may be substantially horizontal or horizontal.

In normal use, the battery may be underneath at least a portion of or substantially all of the suction source.

In normal use, the battery may be underneath at least a portion of or substantially all of the dirt collection chamber and/or cyclonic separator device.

The housing may include a passage having an elongate axis (I) defining an inlet for receiving dirt-laden air.

The axis (I) of the passage may be transverse to the elongate axis (B) of the dirt collection chamber and/or cyclonic separator device and/or the axis (A) of the motor axle.

The axis (I) may intersect a portion of the suction source.

In normal use, the axis (I) may intersect a lower portion of the suction source.

The battery may include a plurality of battery cells.

In normal use, a portion of the cells may be positioned rearwardly of the suction source.

A portion of the cells may be arranged in a first row which extends along an elongate axis of the housing.

A portion of the cells may be arranged in a second row which extends above the first row and wherein the second row may be shorter in length along an elongate axis of the battery than the first row.

The housing may include or may be connected to a user graspable handle for holding the apparatus.

In normal use, the suction source and/or battery may be positioned forwardly of a lower portion of the user graspable handle.

The apparatus may be a handheld surface cleaning apparatus.

The surface cleaning apparatus may include:

a surface cleaning tool;

an elongate member having an elongate axis (E), said elongate member connecting the surface cleaning tool to the housing and including a passage for carrying dirt-laden air from the surface cleaning tool to the dirt collection chamber.

According to a further aspect of the invention we provide a battery for use with a surface cleaning apparatus including:

a housing having first and second ends and which includes:

a first portion for receiving a first group of a plurality of battery cells; and a second portion for receiving a second group including at least one battery cell, wherein the second portion extends above the first portion and wherein there are fewer battery cells in the second group than in the first group.

The first portion may extend from the first to the second end of the housing and the second portion may only extend a portion of the distance along an elongate axis of the battery as measured from the second end towards the first end.

The housing may be L-shaped in cross-section.

According to a further aspect of the invention we provide a battery for use with a surface cleaning apparatus including:

a housing having first and second ends and which includes:

a first portion for receiving a first group of a plurality of battery cells; and a second portion for receiving a second group including at least one battery cell, wherein the first and second portions define a recess which extends part of the distance along an elongate axis of the battery as measured from the first end to the second end.

The first portion may define a first wall of the recess and the second portion may define a second wall of the recess.

The second wall may extend transversely away from the first wall.

The second wall may be inclined with respect to the first wall.

The first and second portions may contain the respective first and/or second groups of battery cells.

The first portion may be able to house a maximum number of battery cells which is greater than the maximum number of battery cells that can be housed by the second portion.

The battery cells of the first and second groups may be identical.

According to a further aspect of the invention we provide a surface cleaning apparatus according to any preceding aspect including a battery according to any corresponding preceding aspect.

Embodiments of the invention will be set out below by way of example only with reference to the accompanying figures, of which:

Figure 1:
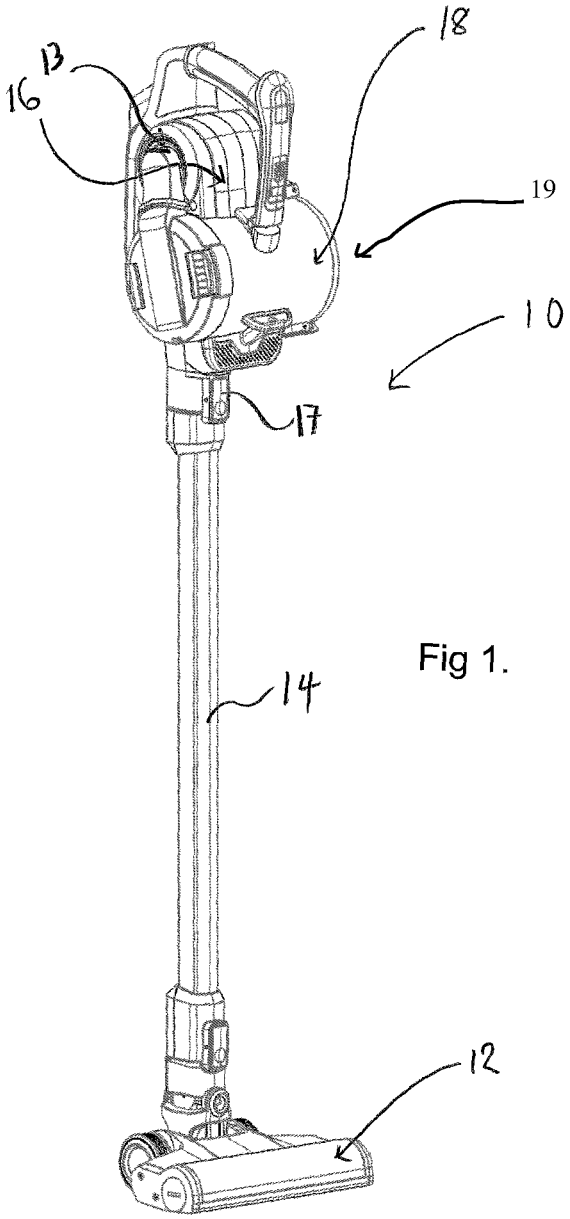
FIG. 1 is a perspective view of a surface cleaning apparatus.

Referring to the figures, these show a surface cleaning apparatus 10 in accordance with the present invention. The apparatus 10 includes a surface cleaning tool 12 (a floor head in this example), a housing 16 having an elongate axis H and an elongate member 14, having an elongate axis E, connecting the surface cleaning tool 12 to the housing 16. The elongate member 14 is relatively rigid. The housing 16, in this example, is operable as a handheld surface cleaning apparatus, commonly known as a hand vac, when the elongate member 14 is not connected thereto, and in this state the housing 16 can be used with or without the surface cleaning tool 12 connected thereto. The housing 16 supports a suction source 13, a dirt collection chamber 18 and a cyclonic separator 19. The suction source 13 and dirt collection chamber 18 are spaced apart along axis H of the housing 16. In this example the suction source 13 is an electric motor driving a rotatable fan, but any appropriate suction source may be used. All that is necessary is for the suction source to be able to draw air through the surface cleaning tool 12 and elongate member 14 towards the dirt collection chamber 18. Dirt collection chamber 18 has an elongate axis B.

Figure 8:
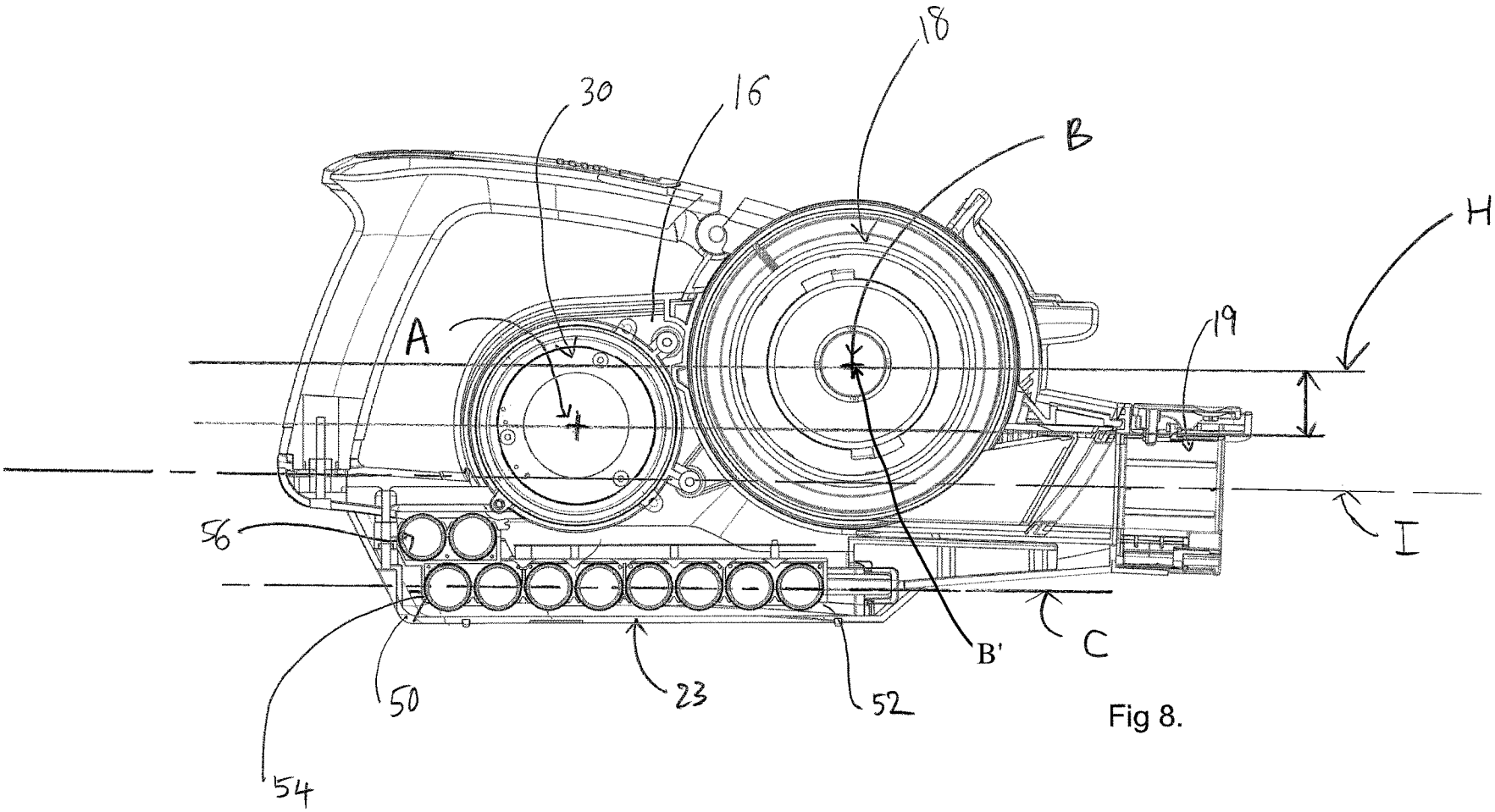
FIG. 8 is a cross-sectional view of the housing from the same side as shown in FIG. 7.

FIG. 8 shows the elongate axis H at a particular height but it will be appreciated that the axis H could be a different height and that axis H should be understood to denote an axis which is parallel to the horizontal or lengthwise direction in which the housing 16 extends between its distal ends, as viewed in side cross-section (such as that shown in FIG. 8). In other words, parallel to the generally elongate dimension of the housing 16.

In this example the housing 16 supports or contains a battery 23 to provide electrical power to the suction motor and other components of the apparatus 10. Battery 23 is of a generally elongate shape and has an elongate axis C. Axis C is parallel to the axis H of the housing 16. FIG. 8 shows the elongate axis C at a particular height but it will be appreciated that the axis C could be a different height and that axis C should be understood to denote an axis which is parallel to the horizontal or lengthwise direction in which the battery 23 extends between its distal ends, as viewed in side cross-section (such as that shown in FIG. 8). In other words, parallel to the generally elongate dimension of the battery. In alternative embodiments, the apparatus 10 may be mains powered.

In this example, the housing 16 includes a passage 19 in fluid communication with an inlet of the cyclonic separator. Passage 19 has an elongate axis I and defines an inlet for receiving dirt-laden air and the inlet is connectable to the elongate member 14. When connected, axis I is parallel to the elongate axis E of the elongate member. In embodiments, axis I may be co-axial or offset from the elongate axis E.

Whilst in the present embodiment the apparatus 10 includes a cyclonic separator to separate dirt from the air flowing through the apparatus 10, this is not essential. Indeed, embodiments are envisaged where the apparatus 10 includes a filter bag which collects dirt, or any other appropriate device to separate the dirt from the air. The apparatus 10 includes a pivotally moveable door 18*a* which enables a user to empty dirt collected within the chamber 18.

The elongate member 14 includes a passage for carrying dirt-laden air from the surface cleaning tool 12 to the dirt collection chamber 18. In this example the surface cleaning tool 12 includes a motor for driving a rotatable floor agitating member or brush, so the elongate member 14 includes a further passage through which electrical cables may extend to provide an electric connection between the housing 16 and the motor in the surface cleaning tool 12.

The surface cleaning tool 12 is disconnectable from the elongate member 14, so that, for example, another tool can be connected to the free end of the elongate member 14. The elongate member 14 is also disconnectable from the housing 16, by way of a manually operated switch 17. This enables the housing 16 to be used as handheld surface cleaning apparatus, with the option of being able to connect another tool to the location from where the elongate member 16 is removed.

The housing 16 includes a handle for holding the apparatus 10, said handle including first 20 and second 21 user-graspable portions which are connected to each other substantially at right-angles. A first end of the first user-graspable portion 20 is connected to the housing 16 and extends generally rearwardly away therefrom and from the elongate member 14. A first end of the second user-graspable portion 21 is connected to the housing 16 and extends generally upwardly therefrom. Respective second ends of the first 20 and second 21 user-graspable portions are connected to each other. Essentially, the first 20 and second 21 user-graspable portions form a handle which is L-shaped and which provides two locations each of which is sized such that it can be grasped fully by a hand of a user. A device 22, e.g. a switch, for turning the apparatus "on" is positioned at the connection of the second ends of the first 20 and second 21 user-graspable portions to each other.

Figure 9:
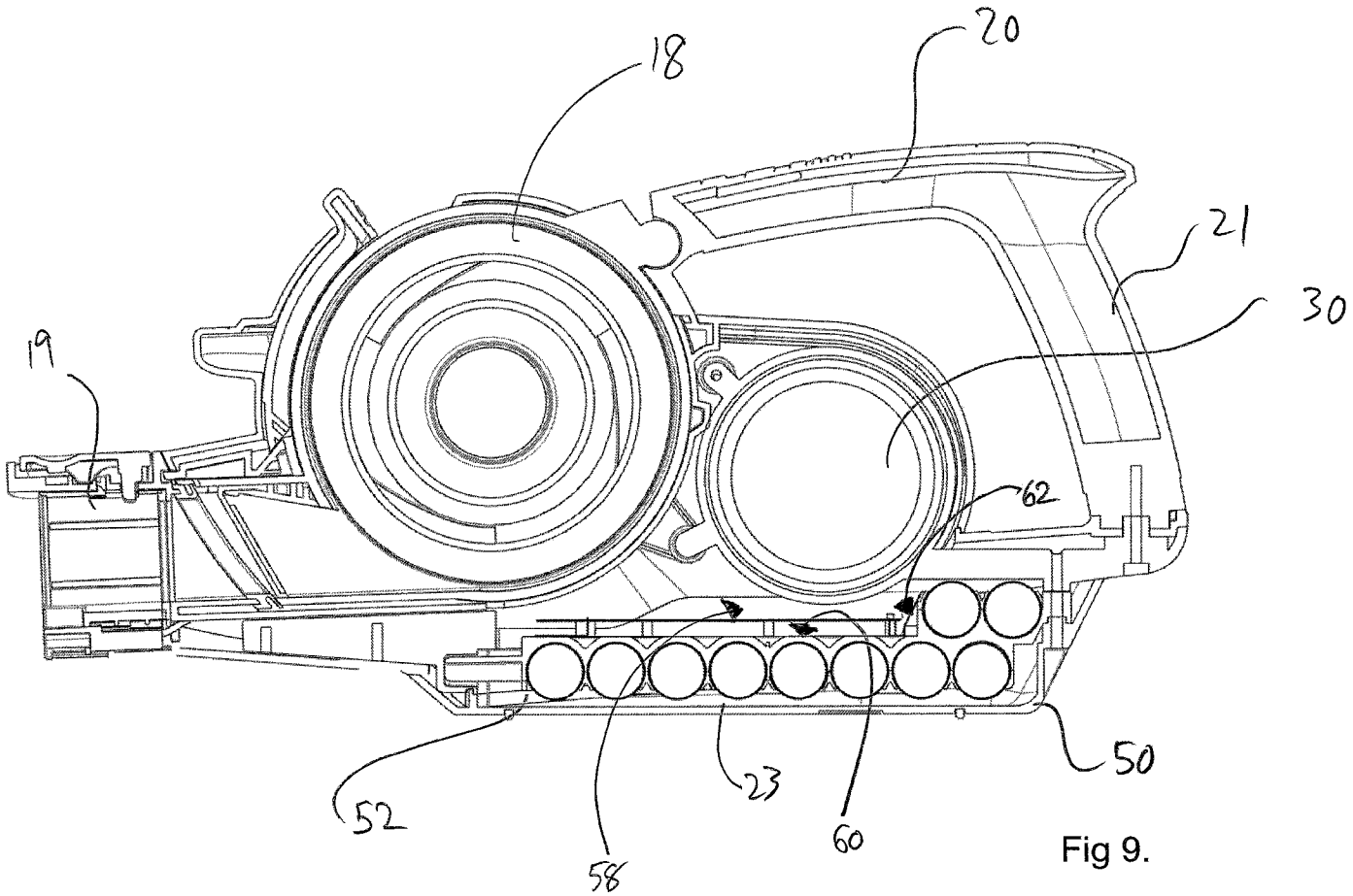
FIG. 9 is a cross-sectional view of the housing from the same side as shown in FIG. 6.
Figure 10:
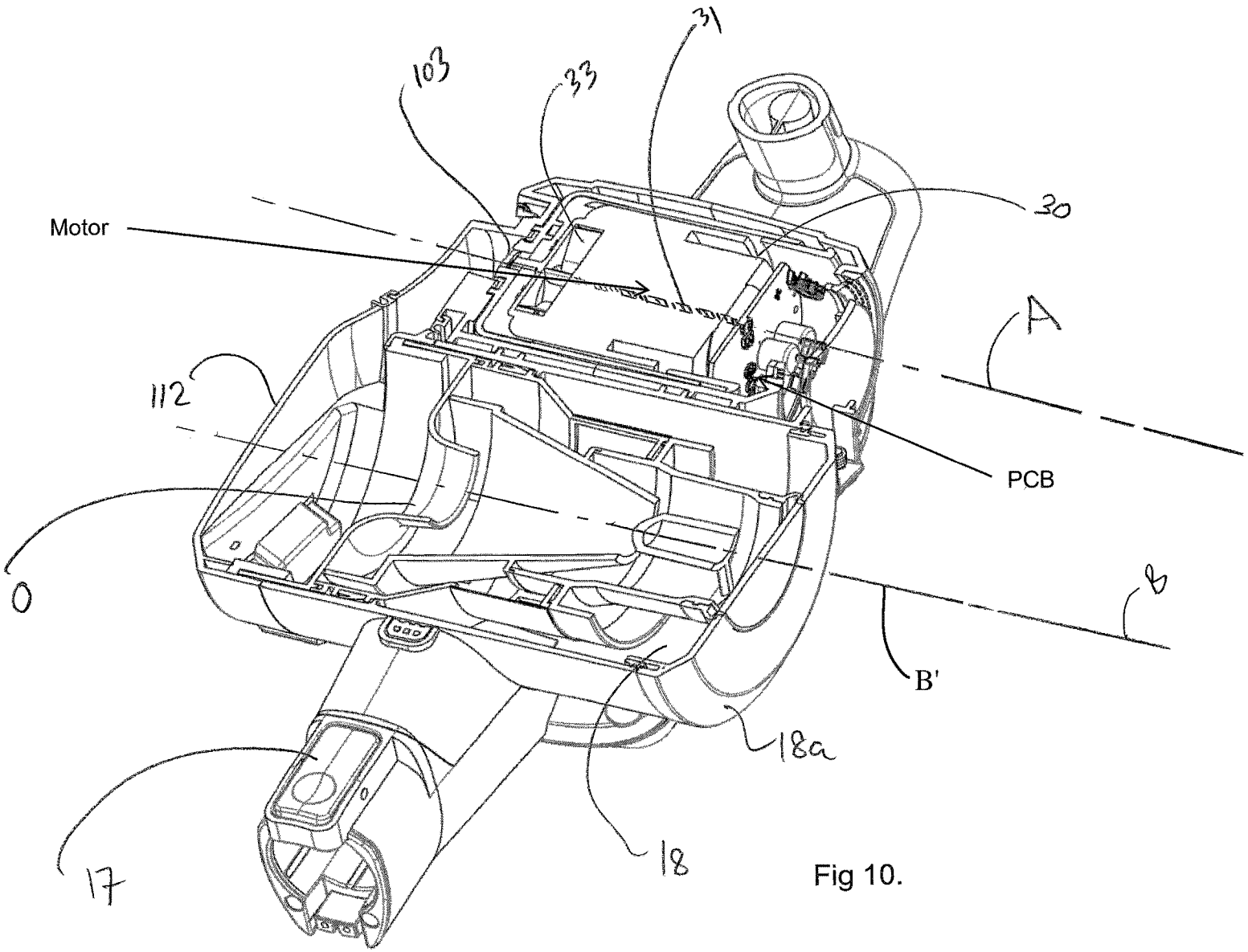
FIG. 10 is a cross-sectional perspective view of the housing of FIG. 5.

As can be seen from FIGS. 8 and 9, the housing 16 supports the suction source 13 which is in the form of an electric motor 30 with an axle 31 which is connected at one end to a fan 33. The axle 31 and fan 33 rotate about an axis A. The motor 30 may be any appropriate motor, e.g. DC, AC, brushless.

The motor 30, axle 31 and fan 33 are positioned such that axis A extends transversely to the elongate axis H of the housing 16. The axis A of the axle 31 and axis B of the dirt collection chamber 18 extend perpendicularly to the axis C of the battery 23. In more detail, it will be appreciated from FIG. 2 that the axis E of the elongate member 14 is substantially perpendicular to the axis A of the axle 31 of the motor 30 when viewed in plan view. It will also be appreciated that the axis C of the battery 23 is below (i.e. underneath) the axis E and below (i.e. underneath) the axis A of the axle 31 when viewed from the side (see FIG. 8). In other words, axes C, E and A lie in respective planes which are parallel to one another and the plane in which C lies is below the other planes in which axes E and A lie.

Figure 2:
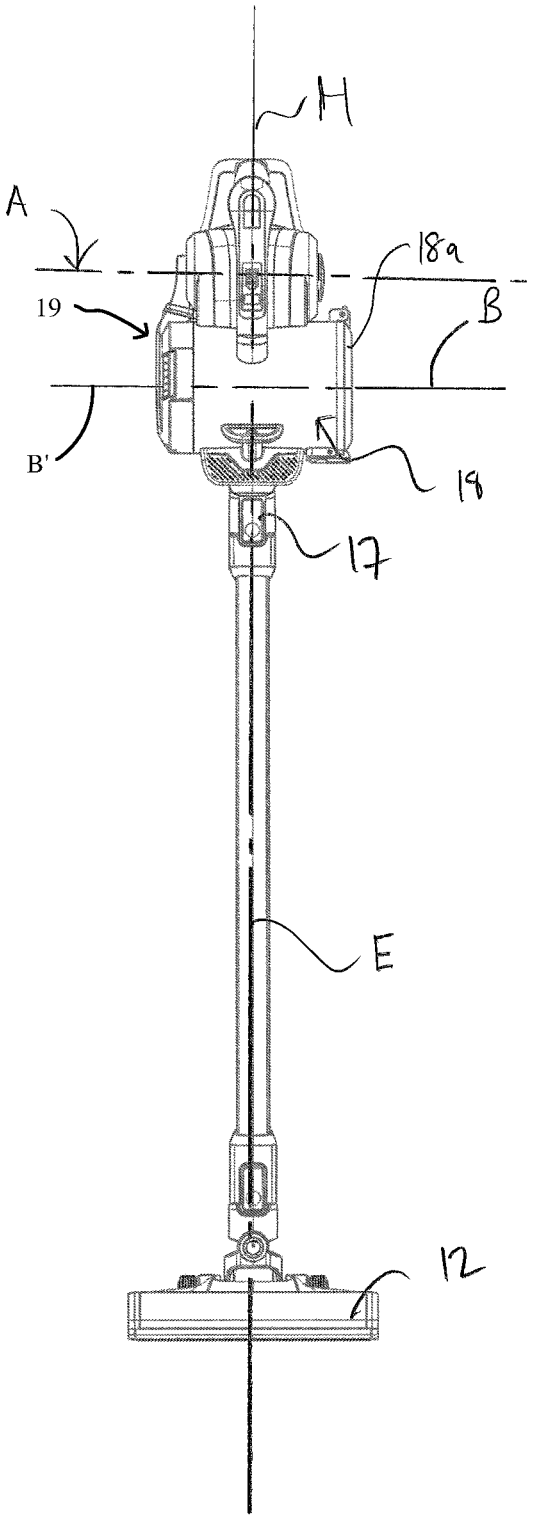
FIG. 2 is a front view of the apparatus of FIG. 1.
Figure 3:
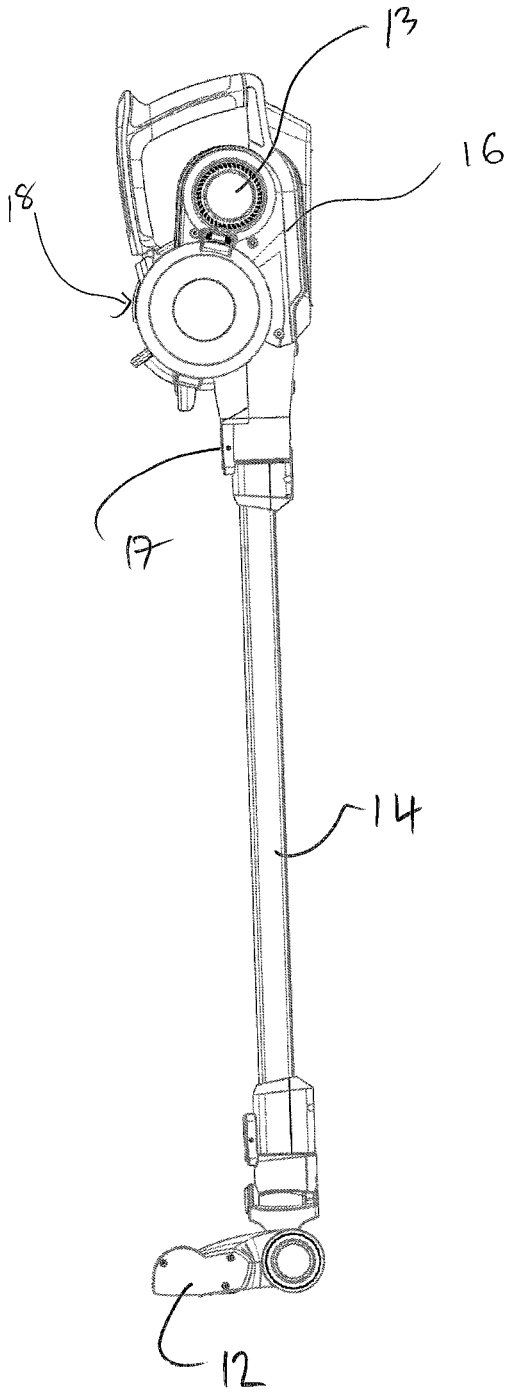
FIG. 3 is a side view of the apparatus FIG. 1.
Figure 4:
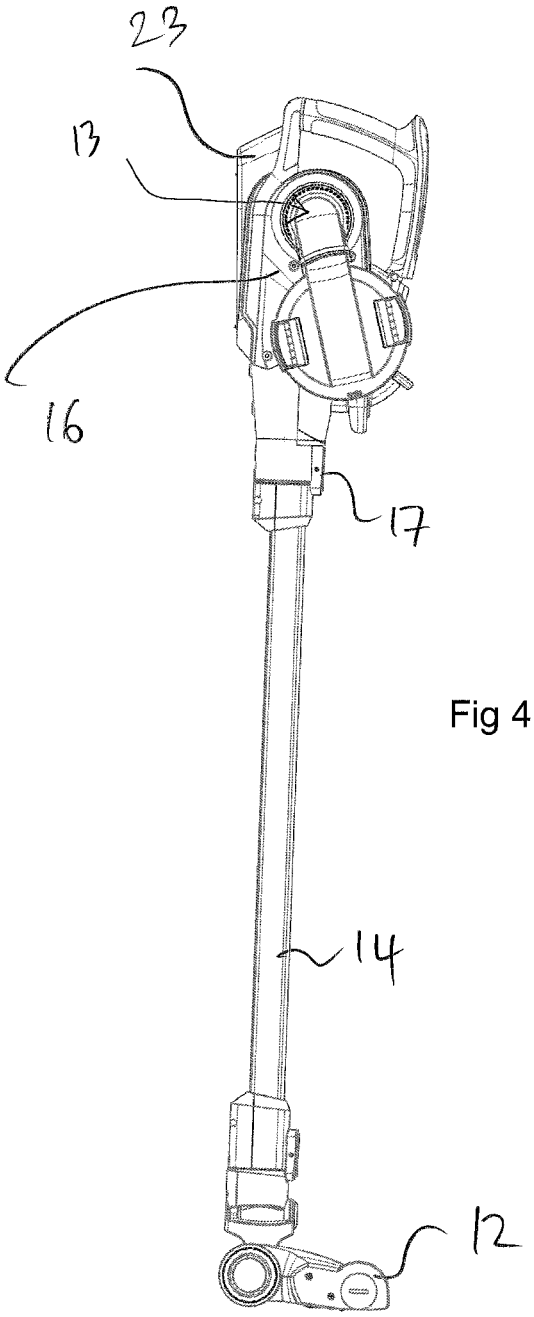
FIG. 4 is an opposite side view of the apparatus FIG. 1.
Figure 5:
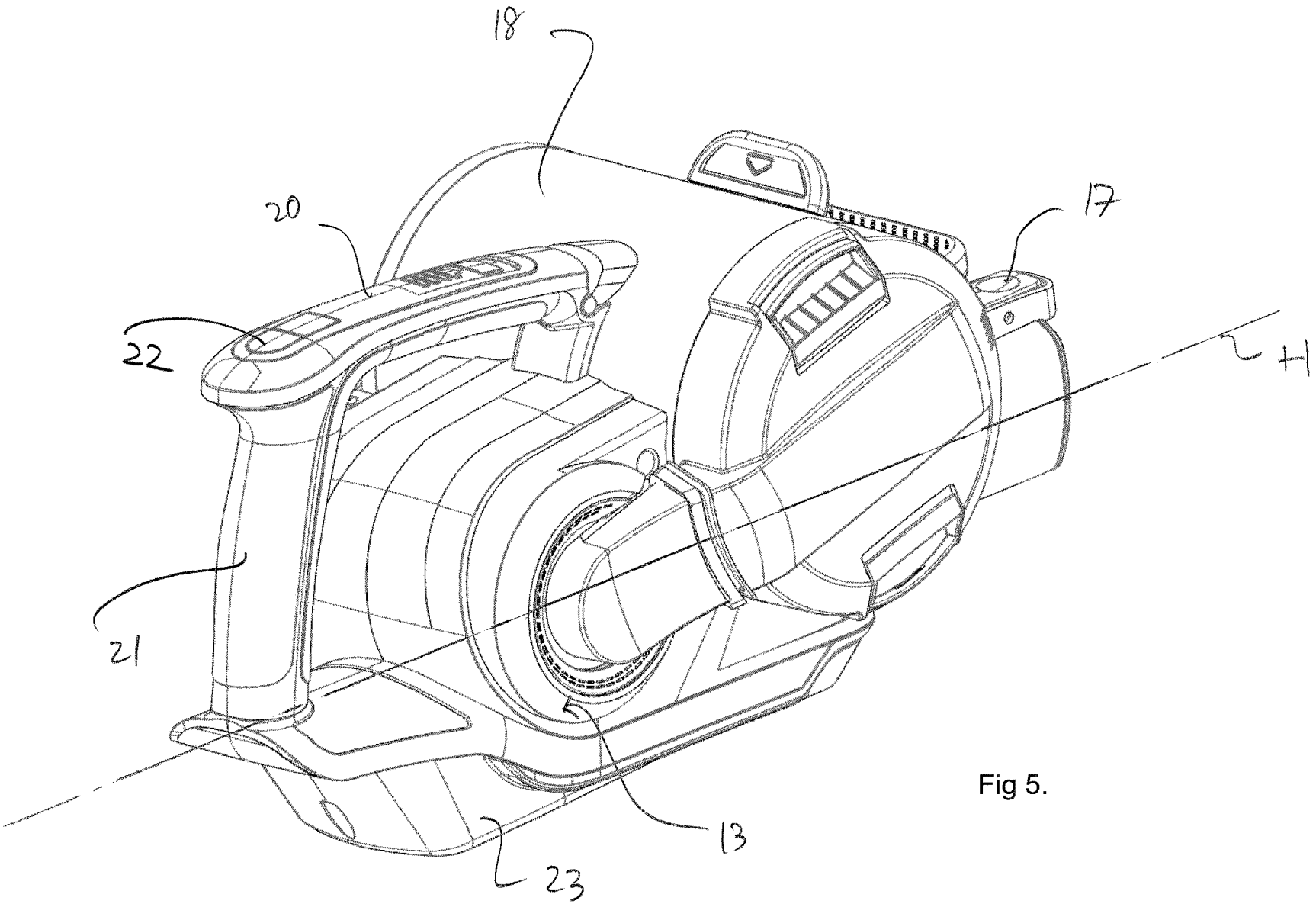
FIG. 5 is a perspective view of a housing of the apparatus of FIG. 1, which housing is operable as a handheld surface cleaning apparatus.
Figure 6:
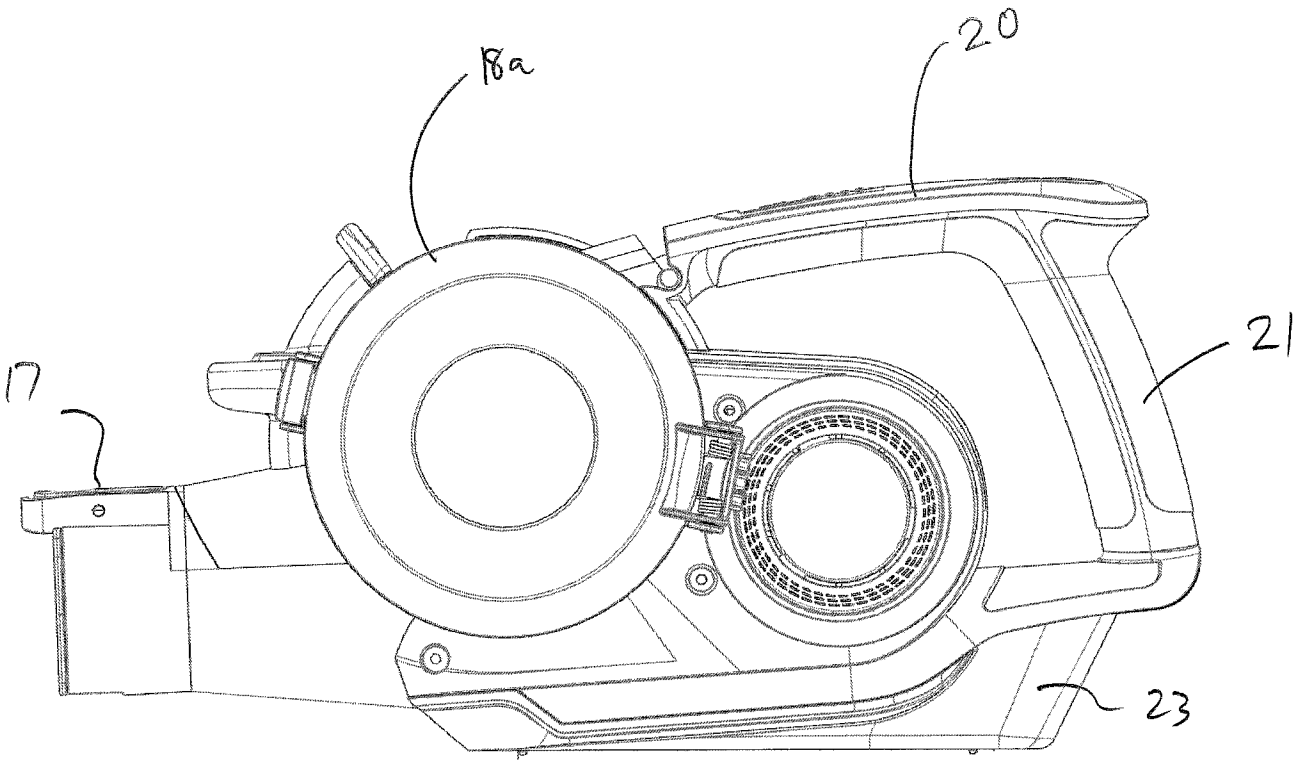
FIG. 6 is a side view of the housing of FIG. 5.
Figure 7:
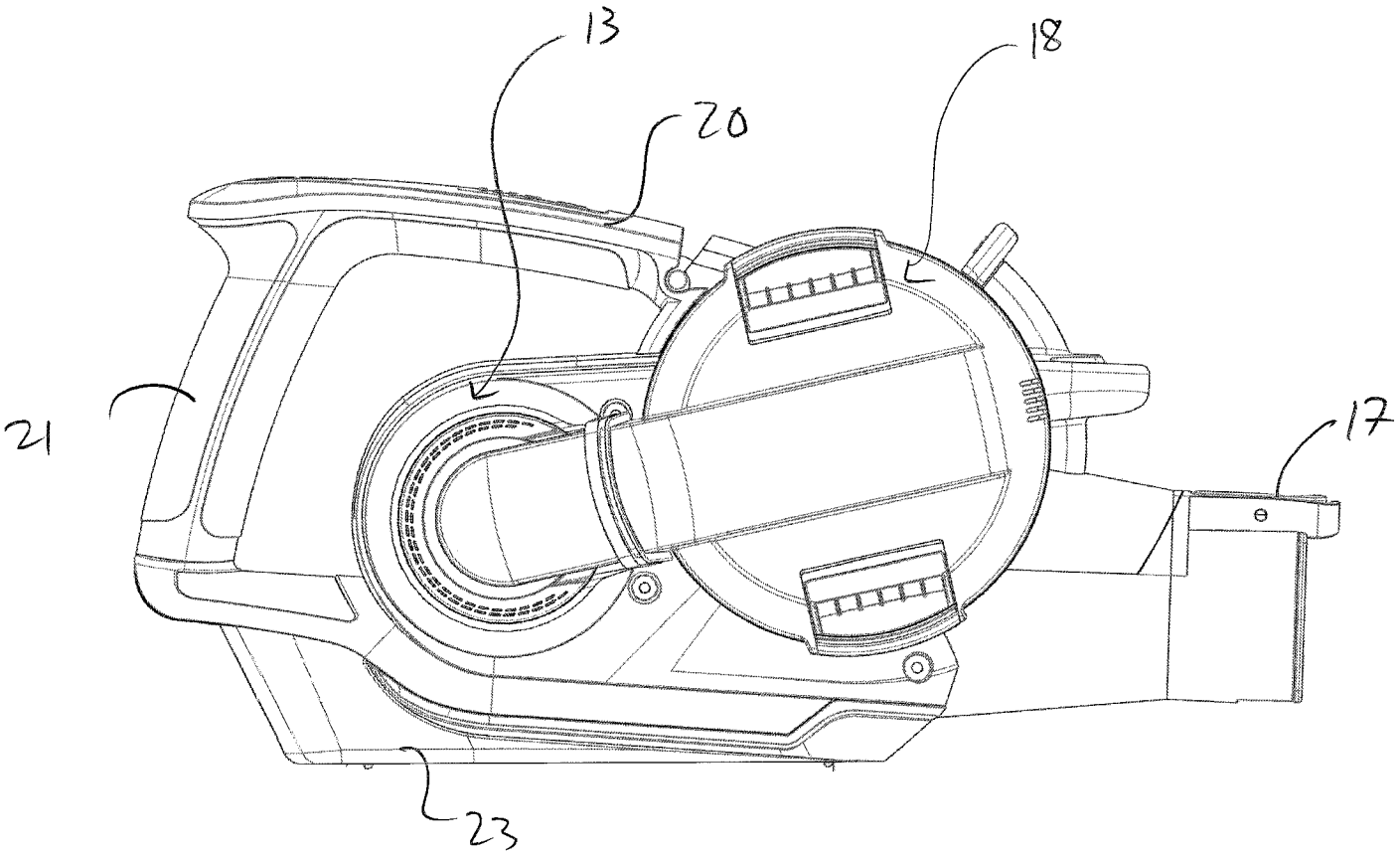
FIG. 7 is an opposite side view of the housing of FIG. 5.

The cyclonic separator device 19 has an elongate axis B' coaxial with the axis B of the dirt collection chamber 18, the axis B being that about which dirt-laden air is caused to rotate as it passes through the apparatus 10. The elongate axis B is substantially horizontal in normal use. The axis B is parallel to the axis A of the axle 31 of the motor 30. It will also be appreciated that the axis B and axis A are offset from each other, with axis B being above axis A. With reference to FIG. 2, it can be seen that, when viewed from the side, axis E of the elongate member 14 is substantially perpendicular to the axis B of the dirt collection chamber 18. It can also be seen from FIG. 3 that axis E is below the axis B and axis A when viewed from the side.

An upstream wall 112 of the housing 16 extends along the elongate axis H of the housing 16 and has an inner surface which partially defines an air flow passage from an inlet 103 of the suction source 13 to an outlet O of the cyclonic separator upstream of the suction source 13.

Normal use of the surface cleaning apparatus 10 refers to use thereof when the elongate axis E is inclined an acute angle with respect to the surface being cleaned. In other embodiments for which the surface cleaning apparatus 10 is a cylinder cleaner, the housing may be generally upright with respect to the floor surface during normal use, and the axes B and C parallel with the floor surface. For embodiments where the apparatus 10 is an upright cleaner, the housing may be inclined with respect to the floor surface and the axes B and C may be parallel with the floor surface during normal use.

In normal use, the axis A of the axle of the motor 30 may lie in a first plane and the elongate axes of the dirt collection chamber/cyclonic separator device B, may lie in a second plane which is parallel to the first plane; wherein the second plane is below the first plane.

It can also be seen that axis I is transverse to the elongate axis B and axis A. In normal use, the axis I intersects a lower part of the suction source 13.

Whilst in this embodiment the elongate axes of the dirt collection chamber 18 and the cyclonic separator device 19 are coaxial or substantially coaxial, they need not be. They could, for example, be parallel and offset from each other.

In normal use, the motor 30 is positioned rearwardly of the dirt collection chamber 18. It will also be appreciated that the battery 23 is positioned below or underneath the motor 30 and the dirt collection chamber/cyclonic separator device. In particular, the elongate axis C is below or underneath the respective axes A and B of the axle 31 and dirt collection chamber 18. This positioning assists in advantageously distributing the weight of the components in the housing 16 whilst minimising the overall height of the apparatus 10.

The arrangement of the suction source, dirt collection chamber and battery described has improved ergonomic characteristics as well as a reduced compact height.

In more detail, battery 23 has a housing having first and second ends 50, 52 which are spaced apart along elongate axis C. The housing has first and second portions 54, 56. The first portion 54 is generally rectangular in shape and the second portion 56 extends upwardly away from an end of the first portion 54. The second portion 56 extends above a part of the first portion 54 in a direction elongate axis C. The first and second portions 54, 56 define a recess 58 which extends part of the distance from the first end to the second end of the battery 23. In more detail, the first portion 54 defines a first wall 60 of the recess 58 and the second portion 56 defines a second wall 62 of the recess 58. The second wall 62 is inclined with respect to the first wall 60. Thus, the battery 23 is generally L-shaped from the side (see FIG. 9). The first and second walls 60, 62 that define the recess 58 abut a corresponding formation (not shown) of the housing 16 when the battery 23 is docked. In other words, the length of the second portion 56 is shorter than the length of the first portion 54 as measured from the first end 50 to the second end 52.

The first portion 54 houses a first group of a plurality of battery cells in a first row and the second portion 56 houses a second group of a fewer number of battery cells in a second row. The second portion 56 extends away from and is positioned rearwardly of the suction source with respect to axis H of the housing 16.

The configuration of the battery is advantageous because the capacity of the battery (which corresponds to the working time of the apparatus) can be changed by simply adding or not adding battery cells to the second portion of the housing during manufacture. In the prior art, the limitations of the battery housing design often mean that for the same housing one must use a different type of battery cell if different battery capacities are required. In contrast, for the present invention, one can use identical battery cells with the same battery housing and the capacity of the battery can be changed by adding more or fewer (identical) batteries depending on the application.

It will be appreciated that any appropriate motor could be used in the apparatus 10, and any appropriate handle configuration could be used.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A surface cleaning apparatus comprising:

a housing having a front end and a back end, the housing defining a passage at the front end of the housing and a user-graspable handle at the back end of the housing, the passage configured to receive dirt-laden air, the housing defining an elongate passage axis extending centrally along the passage in a direction from the front end to the rear end, the housing supporting;

a suction source including a motor with an axle which rotates a fan about an axle axis, the axle axis extending transversely with respect to the passage axis;

a horizontal dirt collection chamber having an elongate dirt collection chamber axis about which the dirt-laden air rotates, the dirt collection chamber defining an inlet fluidly coupled to the passage for receiving dirt-laden air from the passage in response to rotation of the fan about the axle axis, the dirt collection chamber axis is spaced from the axle axis; and a battery for providing power to operate the suction source, wherein the battery has an elongate battery axis, wherein the battery includes a plurality of battery cells, wherein the elongate battery axis extends through a majority of the battery cells;

wherein the axle axis and the dirt collection chamber axis extend transversely with respect to the elongate battery axis, and wherein while the passage axis extends horizontally, both the axle axis and the dirt collection chamber axis are positioned above the elongate axis and the battery axis is positioned below the passage axis.

2. A surface cleaning apparatus according to claim 1, wherein each of the battery cells defines a cylindrical shape with a central axis, the elongate axis of the battery extends through the central axis of a majority of the battery cells, the elongate axis of the battery is substantially parallel to an elongate passage axis.

3. A surface cleaning apparatus according to claim 1, wherein the elongate axis of the battery extends through an elongate length of the battery, and the axle axis is spaced apart from the battery axis a lesser amount than the elongate dirt collection chamber axis is spaced apart from the battery axis.

4. A surface cleaning apparatus according to claim 1 wherein while the dirt collection chamber axis is substantially horizontal and while the passage axis is substantially horizontal, the battery is closer to a surface being cleaned than substantially all of the suction source, and wherein the battery is closer to the surface being cleaned than substantially all of the dirt collection chamber.

5. A surface cleaning apparatus according to claim 1 wherein while the dirt collection chamber axis is substantially horizontal and while the passage axis extends at an acute angle with respect to a surface being cleaned, the suction source and the battery are positioned forwardly of a lower portion of the user graspable handle.

6. A surface cleaning apparatus according to claim 1, wherein while the dirt collection chamber axis is horizontal, and while the passage axis is positioned at an acute angle with respect to a surface being cleaned, a portion of the cells is positioned rearwardly of the suction source and the passage axis intersects a lower portion of the suction source.

7. A surface cleaning apparatus according to claim 6 wherein a portion of the cells is arranged in a first row which extends along an elongate axis parallel to the elongate axis of the passage, wherein a portion of the cells is arranged in a second row which extends above the first row and wherein the second row is shorter in length along the battery axis than the first row, and wherein the battery axis extends through each cell of the portion of cells arranged in the first row.

8. A surface cleaning apparatus according to claim 1, wherein the dirt collection chamber and suction source are spaced apart in the direction of the elongate axis, such that the axle axis is offset from the dirt collection chamber axis.

9. A surface cleaning apparatus according to claim 8, wherein the axle axis lies in a first plane and the dirt collection chamber axis lies in a second plane parallel to and spaced apart from the first plane, wherein while the elongate axis of the dirt collection chamber is substantially horizontal, the second plane is closer to a surface being cleaned than the first plane.

10. A surface cleaning apparatus according to claim 1, wherein the suction source further includes a horizontal cyclonic separator device having an elongate cyclonic separator axis for separating dirt from the airflow through the apparatus, the cyclonic separator axis extending substantially parallel to the dirt collection chamber axis; and wherein the cyclonic separator axis extends transversely with respect to the battery axis, and wherein the axis of the motor axle is spaced from the elongate axis of the cyclonic separator device.

11. A surface cleaning apparatus according to claim 10, wherein the elongate axes of the dirt collection chamber and cyclonic separator device are substantially co-axial.

12. A surface cleaning apparatus according to claim 10, wherein the cyclonic separator device and suction source are spaced apart in the direction of the elongate axis, such that the axle axis is offset from and parallel to the cyclonic separator device axis.

13. A surface cleaning apparatus according to claim 10, wherein the axle axis lies in a first plane and the elongate cyclonic separator axis lies in a second plane parallel to and spaced apart from the first plane, wherein, while the elongate axis of the cyclonic separator device is substantially horizontal the second plane is closer to a surface being cleaned than the first plane.

14. A surface cleaning apparatus according to claim 10 wherein while the dirt collection chamber axis is substantially horizontal and while the passage axis is substantially horizontal, the battery is closer to a surface being cleaned than substantially all of the suction source, and the battery is closer to a surface being cleaned than substantially all of the cyclonic separator device.

15. A surface cleaning apparatus according to claim 10, wherein while the cyclonic separator axis of the is horizontal, a portion of the cells is positioned rearwardly of the suction source and the passage axis intersects a lower portion of the suction source.

16. A hand vac comprising:

a housing having a front end and a back end, the housing defining a passage at the front end of the housing and a user-graspable handle at the back end of the housing, the passage configured to receive dirt-laden air, the housing defining an elongate passage axis extending centrally along the passage in a direction from the front end to the rear end;

a suction source within the housing, the suction source including a motor with an axle which rotates a fan about an axle axis, the axle axis extending transversely to the elongate passage axis;

a dirt collection chamber within the housing, the dirt collection chamber defining an inlet fluidly coupled to the passage for receiving dirt-laden air from the passage in response to rotation of the fan about the axle axis, the dirt collection chamber defining a dirt collection chamber axis about which the dirt-laden air rotates, the dirt collection chamber axis extending parallel to the axle axis about which the fan rotates;

a horizontal cyclonic separator within the housing, the horizontal cyclonic separator defining a horizontal cyclonic separator axis about which the dirt laden air rotates, the horizontal cyclonic separator configured to separate dirt from the dirt-laden air; and a battery positioned within the housing and configured to provide power to the suction source;

wherein while the passage axis extends horizontally, both the axle axis and the dirt collection chamber axis are positioned vertically above the elongate axis and the battery is positioned vertically below the passage axis.

17. A hand vac according to claim 16, wherein the battery includes a plurality of cells, wherein all of the battery cells are positioned vertically below the passage axis.

18. A hand vac according to claim 16, wherein while a user is grasping the user-graspable handle and the passage axis extends at an acute angle with respect to a surface to be cleaned, the axle axis extends substantially horizontally, the dirt collection chamber axis extends substantially horizontally, and the battery is positioned between a surface being cleaned and the suction source.

19. A hand vac according to claim 16, wherein the user graspable handle extends transverse with respect to the dirt collection chamber axis, and wherein the dirt collection chamber is positioned closer to the front end of the housing than the suction source.

20. A hand vac according to claim 16, wherein the passage axis intersects a lower portion of the suction source, and the axle axis is spaced from the passage axis a first distance, wherein the passage axis intersects a lower portion of the dirt collection chamber, and the dirt collection chamber axis is spaced from the passage axis a second distance, wherein the second distance is greater than the first distance.

* * * * *